US005413354A

United States Patent [19]

Miller

[11] Patent Number: 5,413,354

[45] Date of Patent: May 9, 1995

[54] FLYING TOY

[76] Inventor: Leo C. Miller, 1110 Dodson La., Wheaton, Md. 20902

[21] Appl. No.: 214,126

[22] Filed: Mar. 17, 1994

[51] Int. Cl.[6] ..... A63B 65/08

[52] U.S. Cl. ..... 273/426; 446/36; D21/85

[58] Field of Search ..... 446/36, 37, 34, 45, 446/38, 46–48, 39–44; 273/426, 428, 424, 425; D21/85, 86

[56] References Cited

U.S. PATENT DOCUMENTS

| | | | |
|---|---|---|---|
| 2,837,077 | 6/1958 | Frazelle | 273/426 X |
| 2,972,481 | 2/1961 | Shapiro | 273/426 |
| 4,452,461 | 6/1984 | O'Brien | 273/426 |
| 4,708,682 | 11/1987 | Schentrup | 446/66 X |
| 4,722,532 | 2/1988 | Harris | 273/426 |
| 4,817,961 | 4/1989 | Stone | 273/426 |
| 5,045,011 | 9/1991 | Lovik | 273/426 X |

FOREIGN PATENT DOCUMENTS

| | | | |
|---|---|---|---|
| 289489 | 8/1966 | Australia | 273/426 |

*Primary Examiner*—Mickey Yu

[57] ABSTRACT

A hand-launched flying toy formed of three or more equally spaced and substantially coplanar blades or vanes radiating out from a central hub area. The blades are shaped to have minimum air drag and substantially zero aerodynamic lift. When launched the device climbs in a substantially vertical loop, spinning as it goes. At or near the top of the loop, the device (which has become inverted) loses its linear velocity, thereby causing the device to descend spinning to a substantially vertical, relatively soft landing near the user.

3 Claims, 1 Drawing Sheet

FLYING TOY

BACKGROUND OF THE INVENTION

1. Field of the Invention

The present invention relates to the field of hand-launched toys made for the purposes of entertainment, spectator amusement, and/or competition.

2. Description of the Prior Art

The related prior art is known to include numerous hand-launched toys designed for the general purposes noted above. However, as will be pointed out, none of the known prior art teach the structure or are capable of the performance of the present invention. More specifically, the following four issued patents are considered in detail to point out the distinctions between such prior art and the present invention.

U.S. Pat. No. 692,608 to Bristow discloses a device somewhat similar in appearance to the present invention, but different therefrom in several significant respects. The Bristow device exhibits a single and different mode of flight, whether launched horizontally, vertically or otherwise. Its blades are moveably connected at the central hub and are purposely designed differently, with thin leading edges and thicker trailing edges, and are shaped to provide aerodynamic lift.

U.S. Pat. No. 3,881,729 to Block et al also discloses aerodynamic lifting blades. This prior art device performs an entirely different flight characteristic than the present invention; i.e., it performs in a "barrel roll" manner, rotating around the line of flight and thus descends remote from the launcher.

U.S. Pat. No. 4,772,030 to Hunt discloses a device which is significantly more complex and critical of construction than the present invention and has a different flight characteristic. While the Hunt device is designed to become inverted in flight, the inversion is done at the beginning of the flight and it then climbs (inverted) to a stall position before descending. It is designed to specifically avoid pitching up to inversion; see Column 4, lines 39 through 48.

U.S. Pat. No. 4,861,304 to Toews discloses a two-blade indoor toy. This prior art device does not achieve the flight characteristics of the present invention, and in particular it does not become inverted during flight. The construction and method of launch taught by Toews are also different than the present invention.

SUMMARY OF THE INVENTION

The proposed device is intended to provide a flying toy with flight characteristics unique and different from those of the above-described prior art, as well as the Frisbee, various boomerangs, and varieties of Aerobies. These prior art devices execute interesting and useful flight patterns, but do not change their mode of flight in mid-flight from linear travel to passive descent, nor are their flight paths confined to a substantially vertical plane in which they become inverted and land at dramatically lower landing velocity than their launch velocity. The present invention accomplishes all of these desirable flight characteristics in a simple, economical device, creating a new branch of outdoor recreation and amusement.

More specifically, the present invention comprises a hand-launched toy formed of three or more equally spaced, substantially coplanar blades or vanes radiating out from a central hub area. These blades are made of lightweight material and are streamlined to have minimum air drag and substantially zero aerodynamic lifting, as they rotate through the air. The proposed device is launched by simply grasping one of the blades ends and throwing it, so as to impart spin, in a plane tilted upwardly between 5° and 45° from parallelism with the ground. The resulting flight path includes a looping climb, similar to the flight path of an airplane entering a loop, and during which the device becomes inverted. At or near the top of the loop, the device loses its linear velocity and thereafter descends spinning to a substantially vertical, relatively soft landing near the launching site.

From the foregoing it will be seen that the principal objective of this invention is to provide a hand-launched flying toy which spins as it swoops upward in a vertical half-loop, becoming inverted as it looses its linear velocity near the top of the loop, and descends spinning in a passive mode to land softly after its vertical descent.

Another objective of this invention is to provide a toy as described which is economical to manufacture and durable in use.

Another objective of this invention is to provide a toy as described which is less menacing to persons and objects than other flying toys as it ends its flight.

Another objective of this invention is to provide a toy as described which is desirable for outdoor amusement and competitions regarding height of flight, duration of flight, accuracy of landing, etc.

Other objects, purposes, and characteristic features of the present invention will in part be pointed out as the description progresses and in part be obvious from the accompanying drawings wherein.

Figure 1:
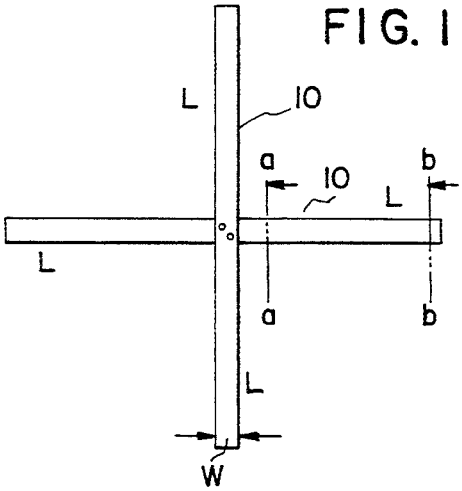
FIG. 1 is a top view of one four-bladed embodiment of the present invention.
Figure 2:
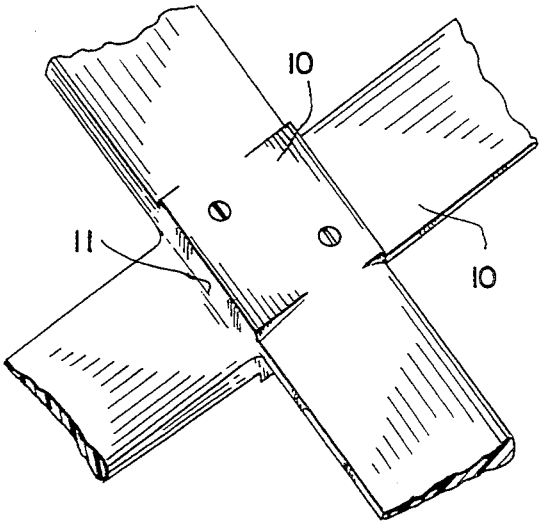
FIG. 2 is a side view of this same embodiment.
Figure 3:
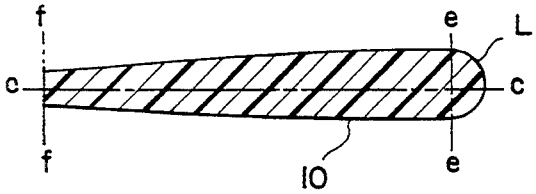
FIG. 3 is a cross-sectional view of a blade member taken along line a—a at the root of a blade in FIG. 1.
Figure 4:
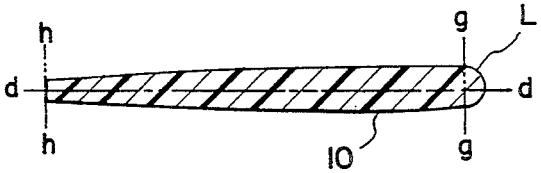
FIG. 4 is a cross-sectional view of a blade member taken along line b—b at the tip of a blade in FIG. 1; and, FIG. 5 is a simplified diagrammatic view of a typical flight path of the proposed toy device.

Referring first to FIG. 1, the illustrated embodiment of the present invention is formed of two crossed blade members 10 (forming separate blades) constructed of light wood or a plastic having similar strength and density characteristics. The members 10 are joined at the center area 11 by glue, double-sided tape, bolts, rivets, or other appropriate fasteners. The blades 10 are stacked at right angles as shown in FIGS. 1 and 2, and as shown in FIG. 2, are tapered in thickness from the joining area 11 so that they are thinner at the tips. FIG. 3 shows the blade cross-section near the hub or root end and is shown as viewed at a—a in FIG. 1. FIG. 4 shows the blade cross-section near the tip, and is shown as viewed at b—b in FIG. 1. The leading edges are shown as L in the drawings. Note that all the blades, from the hub or root a—a to the tip b—b are the same. They are symmetrical about the chords c—c and d—d in FIGS. 3 and 4 respectively which assures that they will provide substantially zero aerodynamic lift. When the unit is thrown by a right-handed person, it will have CCW rotation, as viewed from above, and the L edges will lead. When turned upside down and thrown by a left-handed person, the unit will produce CW rotation and the L edges will lead.

Figure 5:
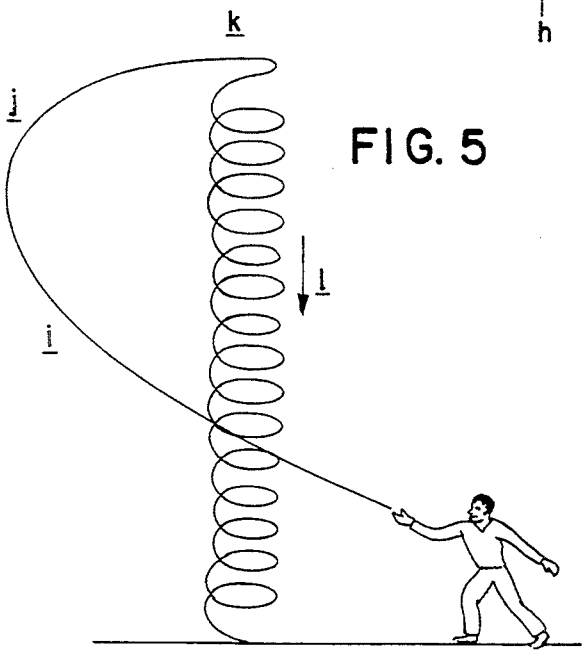

As noted, FIG. 5 is a side view showing the flight profile of the device. Lines i, j, and k are representative of successive edge views of the device as it climbs up, becoming completely inverted at k. The arrow at 1 shows the direction of a typical spinning descent to soft landing while the plane of the blades is substantially horizontal. Flights of test units have reached heights of 50–60 feet, and flight durations of 12–15 seconds.

Listed below are dimensions for one practical embodiment of the invention:

| | |
|---|---|
| Overall length of cross member (includes 2 blades) | 24" |
| Blade width (W in FIG. 1) | $1\frac{1}{2}$" |
| Leading edge blade thickness near the root at e of FIG. 3 | $\frac{1}{4}$" |
| Trailing edge blade thickness near the root at f of FIG. 3 | $\frac{1}{8}$" |
| Leading edge blade thickness near tip at g of FIG. 4 | $\frac{1}{8}$" |
| Trailing edge blade thickness near tip at h of FIG. 4 | 1/16" |
| Density of material | 0.15 oz/cu. in. |

Each of the two crossed members 10 consists of two blades and a central portion for joining to the other member 10. The leading edges of the two blades formed by each member 10 are on opposite ends as shown in FIG. 1 at L. Fabrication of the complete unit is simplified by the fact that the two members are alike. The central portion of each member is flat to provide a good surface for joining.

Various configurations of the device have been assembled and tested, since this is an empirical design, using experiment over theory in the design. The range of configurations included 3, 4, and 6 bladed units, with blade lengths, to center from 9 to 18 inches and widths from $1\frac{1}{2}$ to 4 inches with blade thicknesses from $\frac{1}{8}$ to $\frac{3}{8}$ inches. In each case, the blades were equally spaced about the center, at 360/N, where N is the number of blades.

Test models as described above were made of blade material having densities varying from 0.05 oz/cu. in. to 0.36 oz/cu. in. This range is appropriate for the proposed design, so a density in the median range, 0.15 oz/cu. in. was chosen as typical.

Finally, the presently preferred design was formed of 4 blades, configured as shown in FIGS. 1, 2, 3, and 4. The blade cross-section shown in FIGS. 3 and 4 was chosen because of its characteristic of minimum drag, permitting less attenuation of rotary motion than all others tested.

Various modifications, adaptations or alterations other than those discussed above are of course possible in light of the above teachings and within the scope of the present invention.

What I claim is:

1. A hand-launched flying toy structure comprising in combination: (a) three or more streamlined elongated blades, attached at a central hub to extend radially from said central hub at equal angular spacing, each of said blades oriented to provide zero aerodynamic lift and zero dihedral, (b) said blades, each tapered in thickness from the hub to a thinner tip, (c) each of said blades rounded on it's leading edge and smoothly contoured symmetrically to a thinner trailing edge to provide minimum air drag around the toy's spin axis.

2. A hand-launched flying toy as specified in claim 1 wherein four blades are formed of two members permanently attached at their central portion by adhesive.

3. A hand-launched flying toy as specified in claim 1 wherein four blades are formed of two crossed members removeably attached at their central portion by screws.

* * * * *